US009878872B2

(12) United States Patent
Di Stefano

(10) Patent No.: US 9,878,872 B2
(45) Date of Patent: Jan. 30, 2018

(54) SPINDLE COVER

(71) Applicant: Carmelo Joseph Licciardi Di Stefano, Broadmeadows (AU)

(72) Inventor: Carmelo Joseph Licciardi Di Stefano, Broadmeadows (AU)

(73) Assignee: Acmeda Pty Ltd, Broadmeadows VIC (AU)

( * ) Notice: Subject to any disclaimer, the term of this patent is extended or adjusted under 35 U.S.C. 154(b) by 259 days.

(21) Appl. No.: 14/036,812

(22) Filed: Sep. 25, 2013

(65) Prior Publication Data

US 2014/0097284 A1 Apr. 10, 2014

(30) Foreign Application Priority Data

Oct. 4, 2012 (AU) ..... 2012101508

(51) Int. Cl.

*B65H 75/40* (2006.01)
*E06B 9/322* (2006.01)
*E06B 9/78* (2006.01)

(52) U.S. Cl.

CPC ..... *B65H 75/406* (2013.01); *E06B 9/322* (2013.01); *E06B 2009/785* (2013.01)

(58) Field of Classification Search

CPC .. E06B 9/322; E06B 9/323; E06B 2009/3225; E06B 2009/785; B65H 75/406

See application file for complete search history.

(56) References Cited

U.S. PATENT DOCUMENTS 2,401,770 A * 6/1946 Nardulli ..... E06B 9/308 160/170
3,439,726 A * 4/1969 Lageson ..... E06B 9/308 160/170
4,334,572 A * 6/1982 Frei ..... E06B 9/322 160/170
4,492,261 A * 1/1985 Chong ..... E06B 9/78 160/319
4,621,673 A * 11/1986 Georgopoulos ..... E06B 9/32 160/168.1 R
5,123,472 A * 6/1992 Nagashima ..... E06B 9/307 160/170
5,560,414 A * 10/1996 Judkins ..... E06B 9/262 16/442
5,586,631 A * 12/1996 Benthin ..... E06B 9/90 160/297
5,634,244 A * 6/1997 Fetsch ..... A44C 5/185 160/178.1 R
5,791,393 A * 8/1998 Judkins ..... E06B 9/322 160/308

(Continued)

FOREIGN PATENT DOCUMENTS

AU 2012100444 5/2012
WO WO2008094720 8/2008
WO WO2012007094 1/2012

*Primary Examiner* — Michael E Gallion
(74) *Attorney, Agent, or Firm* — Head, Johnson, Kachigian & Wilkinson, PC

(57) ABSTRACT

A cord winder spindle cover housing, wherein the housing is mountable onto a spindle, and said housing has (i) a drive portion for receiving a cord that controls the extension and retraction of a blind and (ii) at least one opening through which the cord passes, the opening defined by a pair of spaced but opposing convex surfaces.

5 Claims, 4 Drawing Sheets

(56) References Cited

U.S. PATENT DOCUMENTS

| | | | | |
|---|---|---|---|---|
| 5,906,233 | A * | 5/1999 | May | E06B 9/326<br>160/178.1 R |
| 7,128,126 | B2 * | 10/2006 | Smith | E06B 9/262<br>160/121.1 |
| 9,341,020 | B1 * | 5/2016 | Kao | E06B 9/262 |
| 2002/0069977 | A1 * | 6/2002 | Lai | E06B 9/326<br>160/168.1 R |
| 2003/0145959 | A1 * | 8/2003 | Bohlen | E06B 9/322<br>160/170 |
| 2003/0201076 | A1 * | 10/2003 | Nien | E06B 9/32<br>160/168.1 R |
| 2004/0226663 | A1 * | 11/2004 | Smith | E06B 9/262<br>160/84.05 |
| 2006/0118248 | A1 * | 6/2006 | Anderson | E06B 9/262<br>160/84.04 |
| 2006/0272783 | A1 * | 12/2006 | Smith | E06B 9/262<br>160/121.1 |
| 2007/0169900 | A1 * | 7/2007 | Chen | A47H 5/14<br>160/321 |
| 2008/0053626 | A1 * | 3/2008 | Jarosinski | E06B 9/322<br>160/168.1 P |
| 2009/0008046 | A1 * | 1/2009 | Roetgering | E06B 9/322<br>160/321 |
| 2011/0024063 | A1 * | 2/2011 | Cheou | E06B 9/303<br>160/309 |
| 2013/0269888 | A1 * | 10/2013 | Di Stefano | E06B 9/24<br>160/340 |
| 2013/0340951 | A1 * | 12/2013 | Yu | E06B 9/322<br>160/168.1 P |
| 2015/0007946 | A1 * | 1/2015 | Yu | E06B 9/38<br>160/84.02 |

* cited by examiner

SPINDLE COVER

CROSS-REFERENCE TO RELATED APPLICATIONS

This application claims priority to Australia Patent Application No. 2012 101508 filed Oct. 4, 2012 which is incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

SEQUENCE LISTING

Not Applicable

BACKGROUND OF THE INVENTION

Field of the Invention

The present invention relates to a fitting for blind systems, and in particular, a winder spindle cover used with winders for controlling the extension and retraction of a screen of a blind system.

Prior Art

A winder refers to a user-operated blind component (or fitting) that is rotatable for, for example, extending and retracting a cover or structure, such as a window blind. A winder can also be referred to as a clutch device or mechanism. Such fittings typically have a drive portion that engages a cord. The cord itself may or may not be beaded. For example, the cord may be referred to as a bead chain, which can be (but is not limited to) of a plastic or metal construction (or combinations thereof). For example, the cord may be pulled in one direction to rotate the fitting in a blind extending direction, and the cord may be pulled in an opposite direction to rotate the fitting in a blind retracting direction.

During use, a user may attempt to pull the cord in various directions which may cause the blind materials and fittings to undergo significant stress as the blind is fully retracted or extended. When pulled quickly, the beads on the cord also become noisy as they impact the opening in any cord winder spindle cover which over time may cause damage or failure of the cover. Typically cords are also provided with stops which are attached to the cord at positions that represent positions immediately before the blind being fully retracted or extended. In this way, the stops impart impaction stress to the cover rather than the blind materials or fitting, and over time the cover may fail or be damaged.

It is therefore desired to address one or more of the above issues or problems.

BRIEF SUMMARY OF THE INVENTION

According to the present invention, there is provided a cord winder spindle cover housing, wherein the housing is mountable onto a spindle, and said housing has (i) a drive portion for receiving a cord that controls the extension and retraction of a blind and (ii) at least one opening through which the cord passes, the opening defined by a pair of spaced but opposing convex surfaces.

Preferably the opening narrows toward the mid-point of the opening.

According to the present invention, there is provided a winder, including:

(i) a support member having a spindle; and (ii) a housing mounted onto said spindle, said housing having (i) a drive portion for receiving a cord that controls the extension and retraction of a blind and (ii) at least one opening through which the cord passes, the opening defined by a pair of spaced but opposing convex surfaces.

Preferably, the opening narrows towards the mid-point of the opening.

Preferably, the cord includes at least one stop having an impacting dimension less than the opening but more than the dimension defined by the pair of spaced but opposing convex surfaces.

By having opposing convex surfaces, the cord, if beaded, presents an angle of deflection to that surface much less than the almost 90 degree angle of impact presented in conventional winders by beads to the housing. Therefore the impact stresses and associated noise are reduced which results in quieter operation, better housing integrity and longevity.

If a stop is incorporated onto the cord, the entry of the stop into the opening means it is stopped by complementary convex surfaces which reduce the impact stress and results in quieter operation, better housing integrity and longevity.

BRIEF DESCRIPTION OF THE DRAWINGS

Representative embodiments of the present invention are herein described, by way of example only, with reference to the accompanying drawings.

DETAILED DESCRIPTION OF THE INVENTION

Figure 1:
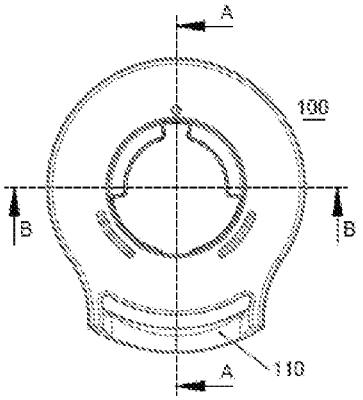
FIG. 1 is a front view of a cover housing.
Figure 2:
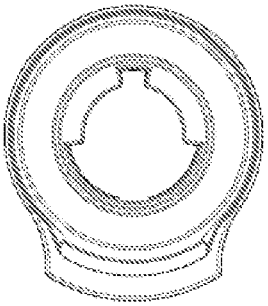
FIG. 2 is a rear view of the cover housing of FIG. 1.
Figure 3:
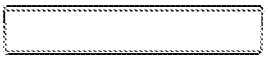
FIG. 3 is a top view of the cover housing of FIG. 1.

FIGS. 1 through 11 depict a cover housing 100. A cord 102 (only shown in exploded view FIG. 9) passes through opening 110 and around the drive 190 and then out of the opening 110. By pulling the cord through the opening 110, the drive is caused to rotate which in turn rotates a blind clutch. The blind is mounted on the blind clutch at one end and also supported at its other end by a mounting.

Figure 7:
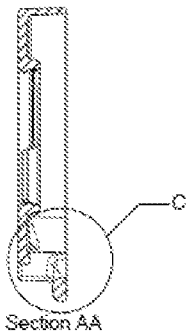
FIG. 7 is a section view along A-A of the cover housing of FIG. 1.
Figure 8:
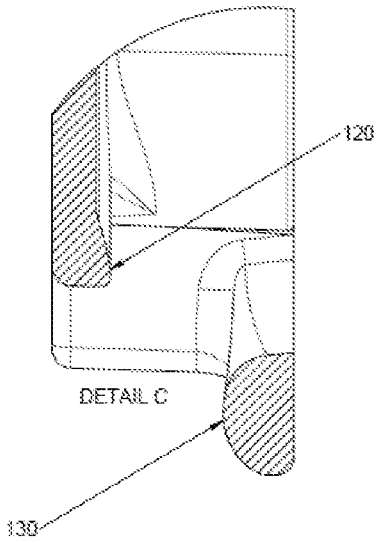
FIG. 8 is an exploded view of the section view of FIG. 7.
Figure 9:
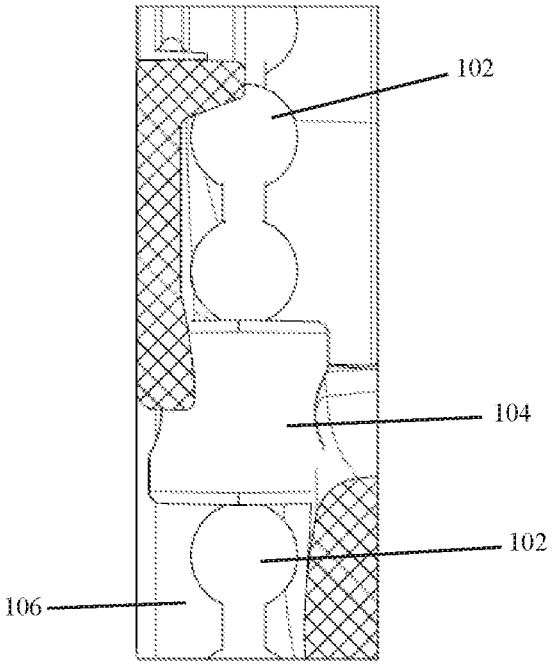
FIG. 9 is an exploded view of the section view of FIG. 7 with a beaded cord.
Figure 10:
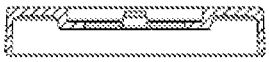
FIG. 10 is a section view along B-B of the winder of FIG. 8.

Opening 110 is provided with a pair of opposed convex surfaces 120 and 130 (more particularly shown in FIGS. 7, 8 and 9). As the surfaces are rounded, the cord entering the opening 110 is not presented to a defined upstanding impact face. This means that the impact of the cord (and beads) into the opening will be minimised and therefore quieter. Similarly, less stress on the opening takes place which reduces failure of the opening materials. Likewise, if the cord has a stop 104 (as shown in FIG. 9), the impact of the stop 104 onto the cover 100 is reduced as the opposing surfaces on the stop 104 and the convex surfaces 120 and 130 are more aligned.

A side surface 106 extending from one of the convex surfaces to the other is also visible.

Figure 11:
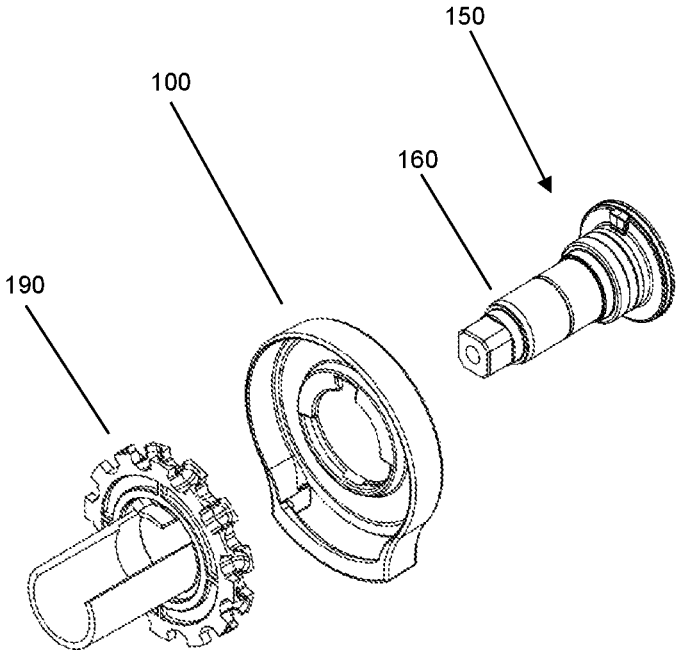
FIG. 11 is an exploded view of a winder in accordance with a preferred embodiment of the present invention.

FIG. 11 depicts a winder in accordance with a preferred embodiment of the present invention. The winder includes support member 150, cover housing 100 and drive portion 190. Support member 150 has a spindle 160.

Figure 4:
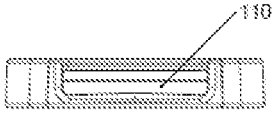
FIG. 4 is an underneath view of the cover housing of FIG. 1.
Figure 5:
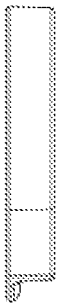
FIG. 5 is a left side view of the cover housing of FIG. 1.
Figure 6:
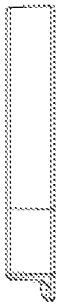
FIG. 6 is a right side view of the cover housing of FIG. 1.

As particularly shown in FIG. 4, the opening 110 narrows towards the mid-point of the opening 110. As such any lateral movement of the cord towards the mid-point of the opening is inhibited or minimized. This means there is less likelihood of tangling and jamming of the cord as it is biased to run through the opening 110 in separate defined portions of the opening.

Modifications and improvements to the invention will be readily apparent to those skilled in the art. Such modifications and improvements are intended to be within the scope of this invention.

In this specification where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

The word 'comprising' and forms of the word 'comprising' as used in this description and in the claims does not limit the invention claimed to exclude any variants or additions.

The invention claimed is:

1. A cord winder spindle cover housing, wherein the housing is mountable onto a spindle, and said housing comprising:

(i) a drive portion for receiving a cord that controls the extension and retraction of a blind;

(ii) at least one opening through which the cord passes, the opening defined by a pair of spaced convex surfaces facing one another, the pair of spaced convex surfaces are arranged offset to one another in a direction transverse to the longitudinal axis of the spindle, and at least one side surface extending from one of the pair to the other of the pair of spaced convex surfaces; and (iii) wherein the cord includes at least one stop having an impacting dimension less than the opening but more than the dimension defined by the pair of spaced convex surfaces.

2. A cord winder spindle cover according to claim 1 wherein the opening narrows toward the mid-point of the opening.

3. A winder comprising:

(i) a support member having a spindle;

(ii) a housing mounted onto said spindle, said housing having (i) a drive portion for receiving a cord that controls the extension and retraction of a blind and (ii) at least one opening through which the cord passes, the opening defined by a pair of spaced convex surfaces facing one another, the pair of spaced convex surfaces are arranged offset to one another in a direction transverse to the longitudinal axis of the spindle, and at least one side surface extending from one of the pair to the other of the pair of spaced convex surfaces; and (iii) wherein the cord includes at least one stop having an impacting dimension less than the opening but more than the dimension defined by the pair of spaced convex surfaces.

4. A winder according to claim 3 wherein the opening narrows towards the mid-point of the opening.

5. A winder according to claim 4 wherein the cord includes at least one stop having an impacting dimension less than the opening but more than the dimension defined by the pair of spaced but opposing convex surfaces.

* * * * *